US005207169A

United States Patent [19]

Mario

[11] Patent Number: 5,207,169

[45] Date of Patent: May 4, 1993

[54] AUTOMATIC MACHINE FOR STITCHING OF VARIOUS ARTICLES, IN PARTICULAR LEATHER ARTICLES

[76] Inventor: Ciucani Mario, Via S. Girolamo, Fermo (A.P.), Italy

[21] Appl. No.: 931,256

[22] Filed: Aug. 17, 1992

[30] Foreign Application Priority Data

Aug. 28, 1991 [IT] Italy ..... 000309/91[U]

[51] Int. Cl.[5] ..... D05B 15/00; D05B 27/20

[52] U.S. Cl. ..... 112/49; 112/62; 112/310; 112/321; 112/235

[58] Field of Search ..... 112/49, 50, 51, 53, 112/60, 62, 61, 28, 235, 47, 63, 136, 310, 321, 153

[56] References Cited

U.S. PATENT DOCUMENTS

| | | | |
|---|---|---|---|
| 2,029,099 | 1/1936 | Gouldbourn | 112/62 |
| 2,046,933 | 7/1936 | Berger | 112/63 |
| 3,056,363 | 10/1962 | Bergeron . | |
| 3,081,719 | 3/1963 | Fake . | |
| 3,187,703 | 6/1965 | Fake . | |
| 4,274,345 | 6/1981 | Schneider et al. | 112/51 |
| 4,848,252 | 7/1989 | Ciucani . | |

FOREIGN PATENT DOCUMENTS

| | | |
|---|---|---|
| 2935382 | 11/1980 | Fed. Rep. of Germany . |
| 122589 | 3/1919 | United Kingdom . |
| 2013435 | 4/1979 | United Kingdom . |

*Primary Examiner*—Clifford D. Crowder
*Assistant Examiner*—Paul C. Lewis
*Attorney, Agent, or Firm*—McAulay Fisher Nissen Goldberg & Kiel

[57] ABSTRACT

In a machine with a longitudinal guide forming, at both sides, two working surfaces, onto which articles are arranged for sewing their upper edges, there is provided a wrinkling device in which two vertical presser feet, inner and outer, are moved vertically in an independent manner and in time relation with the motion of a needle, so that they make wrinkles on an edge of the articles, in alternate position with stitches. The needle, provided with a thread, cooperates with a rotary hook connected with a spool of stitching thread; the needle extends in an arc concentric to a shaft that moves the needle with oscillatory and translatory longitudinal to-and-fro motion.

7 Claims, 3 Drawing Sheets

AUTOMATIC MACHINE FOR STITCHING OF VARIOUS ARTICLES, IN PARTICULAR LEATHER ARTICLES

BACKGROUND OF THE INVENTION

The present invention relates to the technical sector concerning the stitching of leather articles and the like.

Particularly the invention concerns an automatic machine for stitching leathers, e.g. the shoe upper and patch.

DESCRIPTION OF THE PRIOR ART

There are known various types of automatic machines for stitching leathers, e.g. shoe upper and patch.

Such machines include generally a base body provided in a front part with a protruding head, in which the means supporting the needle and the relative movement organs are housed.

The needle is operated vertically in the direction of an underlying horizontal arm on which the leathers to be stitched are placed; the head contains also the members for the horizontal motion of the needle, in the direction parallel to the arm.

The cited machines are provided also with feeding means designed to cause, at every stitch, the advancement of the two edges of the leathers to be stitched, superimposed one on the other.

These machines have one working surface, and this fact reduces their working capability, because of the need of superimposing the edges to be stitched.

To resolve this problem there has been proposed a machine designed to stitch the edges arranged in any way with respect to each other, illustrated in the U.S. Pat. No. 4,848,252 in the name of the Applicant.

Such a universal machine comprises one longitudinal guide that forms laterally inclined flat surfaces, converging at the top; such surfaces form respectively first and second work surfaces on which the leathers to be stitched are made to advance.

Over the guide there is placed longitudinally a shaft designed to be operated in oscillating motion.

A needle extending in an arc and provided with a thread, is mounted tangentially on the free end of an arm keyed on this shaft, and is made to oscillate alternatively between lowered and raised positions so as to pierce the edges of the leathers.

A rotary hook device, connected to a spool of stitching thread, is adapted to work in cooperation with the needle to make the stitching.

The machine cited above can perform the stitching of the edges no matter what the orientation and shape is.

However, for this machine it is not possible to perform certain kind of ornamental stitching that are currently requested in this productive field, such as the wrinkling of the stitching edge.

SUMMARY OF THE INVENTION

The object of the present invention is to propose an automatic machine for sewing articles made of leather, this machine being able to stitch the edges no matter of how they are arranged or shaped and also to perform the wrinkling of at least one edge of the stitching.

A further object of this invention is to propose an automatic machine for sewing leather articles that are made in accordance with a technical solution simple, safe in its working and reliable, and versatile in use.

The above mentioned objects are achieved by means of an automatic machine for sewing articles made of leather and comprising:

a longitudinal guide that forms two sloping flat surfaces converging at the top and forming first and second working surfaces respectively, with articles to be sewn arranged on top of said working surfaces;

a first shaft oriented longitudinally and rotatably supported over said guide, this first shaft being made to reciprocate axially and to move with to-and-fro movement in time relation with its reciprocating motion; an arm keyed onto said first shaft;

a needle extending in an arc and provided with a thread, this needle being tangentially secured to the free end of said arm and alternatively situated, as a result of the reciprocating motion of the first shaft, at a raised position, located aside of said first working surface, and at a lowered position in which it passes through a transverse hole made in said guide while piercing upper edges of said articles;

a rotary hook device located aside of said second working surface and adapted for cooperating with said needle to make stitches;

means moved longitudinally with a to-and-fro motion in time relation with the oscillatory motion of said needle and designed to feed said articles in a preset direction and in synchrony with the motion of said shaft in the same direction.

This machine has been improved so that now it includes:

a wrinkling device moved longitudinally in synchrony with the axial translation of said first shaft; an inner presser foot and an outer presser foot in respect of said underlying first working surface, these presser feet being connected with said wrinkling device and moved indipendently of each other between a raised idle position and a lowered operative position, said inner presser foot being adapted to make, when at its operative position, a wrinkle arranged along a region of said upper edge of said article situated on top of said first working surface, while said outer presser foot holds, when at the operative position, a thread portion that is external with respect to said wrinkle;

means connected to said wrinkling device for moving vertically said presser feet in time relation with the oscillatory motion of said needle, so that the the raising of said outer presser foot, that occurs in time relation with the raising of said needle and before the raising of said inner presser foot, causes said thread portion to be released from said outer presser foot and to be subsequently temporarily held by said inner presser foot, from which it is lastly released so as to press the outer surface of the said region to fix said wrinkle.

The machine made in accordance with the invention can automatically perform the wrinkling of one of two edges that are joined to each other by a stitching; this operation has traditionally been performed only manually.

The wrinkles obtained are identical to each other, equispaced or even centered with respect to the stitches, if desired.

The aesthetical effect is very pleasant, while the wrinkling operation is performed in a simple way within the normal stitching cycle and without changing any operative time or function of the same cycle.

In particular, the machine maintains the advantages of a versatile use already described in the said U.S. Pat. No. 4,848,252.

BRIEF DESCRIPTION OF THE DRAWINGS

The features of the invention are set out in the following with a specific reference to the accompanying drawings, in which.

DESCRIPTION OF THE PREFERRED EMBODIMENT

Figure 1:
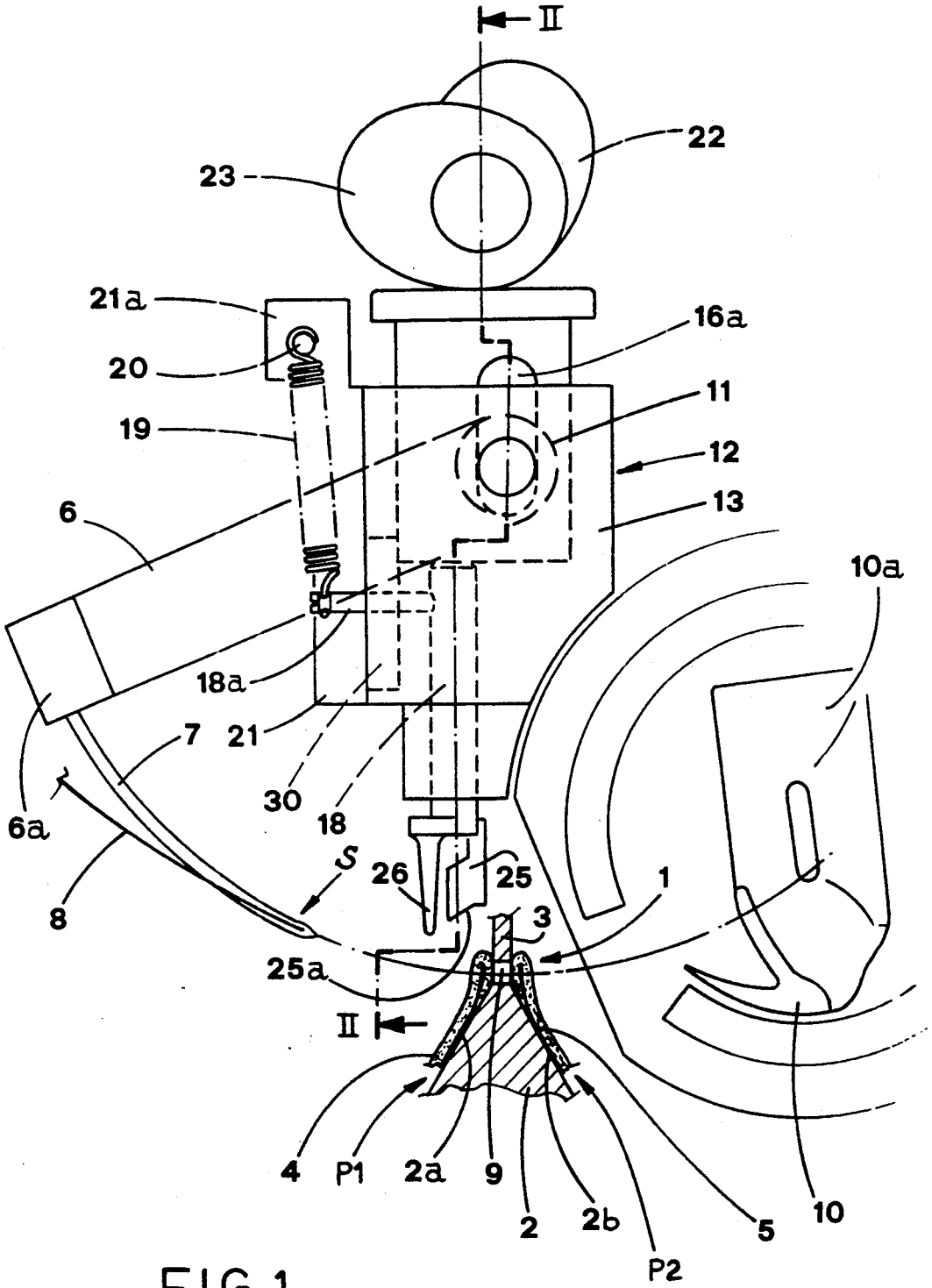
FIG. 1 is a side schematic view of the subject machine.

With reference to the above cited figures, reference numeral 1 indicates a longitudinal guide secured to the frame of the machine (not shown).

The guide includes a lower portion 2, delimited at both sides by sloping flat surfaces 2a,2b that converge at the top, and an upper portion 3, shaped like a vertical fin disposed on the middle longitudinal plane.

The sloping surfaces 2a,2b form, along with the opposed facings of the fin 3, a first working surface P1 and a second working surface P2.

The leathers 4,5 to be stitched are fed on the working surfaces, in step and according to a preset direction N, by means of members that are not shown (for instance, by means of the members shown in the U.S. Pat. No. 4,848,252).

A first shaft 11 is located over the guide 1 and oriented horizontally.

This shaft 11 is made to move axially, with to-and-fro strokes that can be varied, in synchrony with the advancement of the leather 4,5, as shown, for example, in the already cited U.S. patent.

Particularly, the movement in accordance with the direction N is performed in synchrony with the advancement of the leathers 4,5.

An arm 6 is keyed onto the shaft, and a block 6a for locking a needle 7 is tangentially secured to the free end of the arm.

The needle extends in an arc (concentric to the shaft 11) and is provided with a thread 8.

Figure 4:
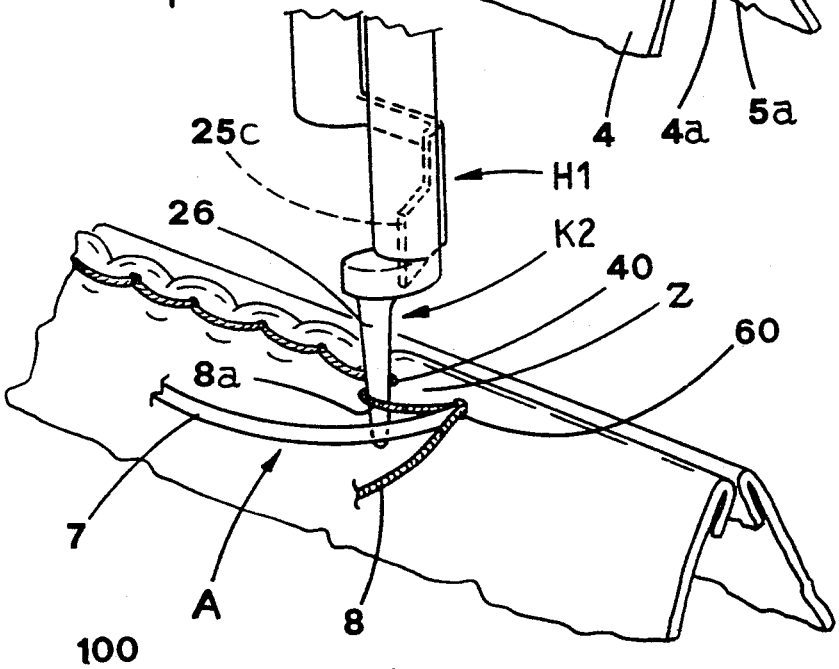
Figure 5:
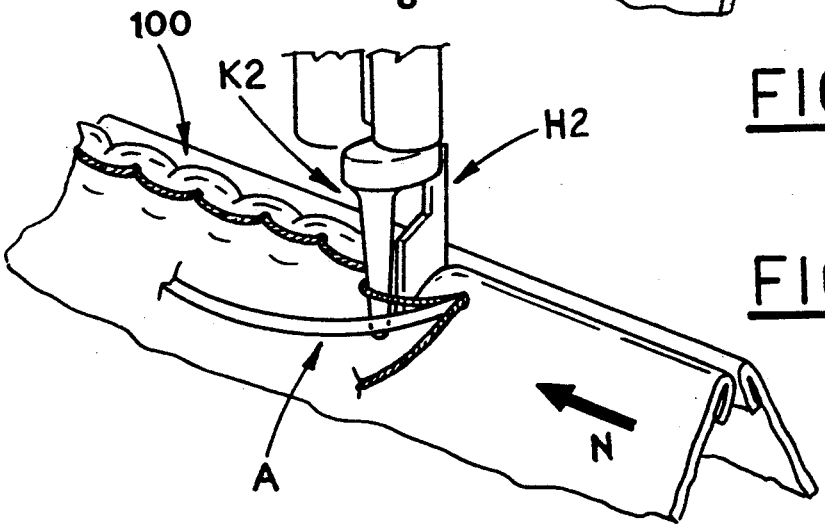

The needle 7 is moved with oscillatory motion from a raised position S (FIG. 1), that is located aside of the first working surface P1, to a lowered position A (FIGS. 4 and 5).

This oscillatory motion takes place in synchrony with the advancement of the leathers (see again the U.S. Pat. No. 4,848,252).

The needle 7 is designed to pass through, while oscillating, a hole 9 made transversely in the guide 1, in the region where the fin 3 joins the lower portion 2.

Aside of the second working surface P2 there is located a conventional rotary hook device 10 indicated in general insofar it is not new), called "crochet", connected with a spool of stitching thread 10a.

The crochet 10 is adapted for cooperating with the needle 7 so as to make the stitching.

A wrinkling device, globally indicated as 12, is linked to the shaft 11 that moves the needle, in accordance with the invention.

This device includes a case 13 open at the top and supported by a second longitudinal shaft 14 that is made to move axially (in a known manner) in synchrony with the longitudinal motion of the shaft 11.

The seat 13a of the case 13 has a parallelepipedal shape so as to form a vertical guide for two slides 15,16 located side by side in the same seat.

These slides have respective vertical slots 15a,16a of a certain height, into which there is freely inserted the portion 14a of the shaft 14 that crosses the seat 13a.

The bottom of the case 13 has two vertical through holes for receiving and guiding respective stems 17,18.

Two presser feet 25,26, inner and outer with respect to the first working surface P1 that is under them, are secured to the lower ends of the stems 17,18.

The inner presser foot 25 has a flat shape and extends vertically; the lower head 25a of the inner presser foot can have various shapes, in accordance with the kind of leather 4 and with the kind of wrinkling that is requested (as it will be better explained in the following).

The outer presser foot 26 is preferibly shaped like a truncated cone having the diameter enlarging from the bottom to the top.

Figure 2:
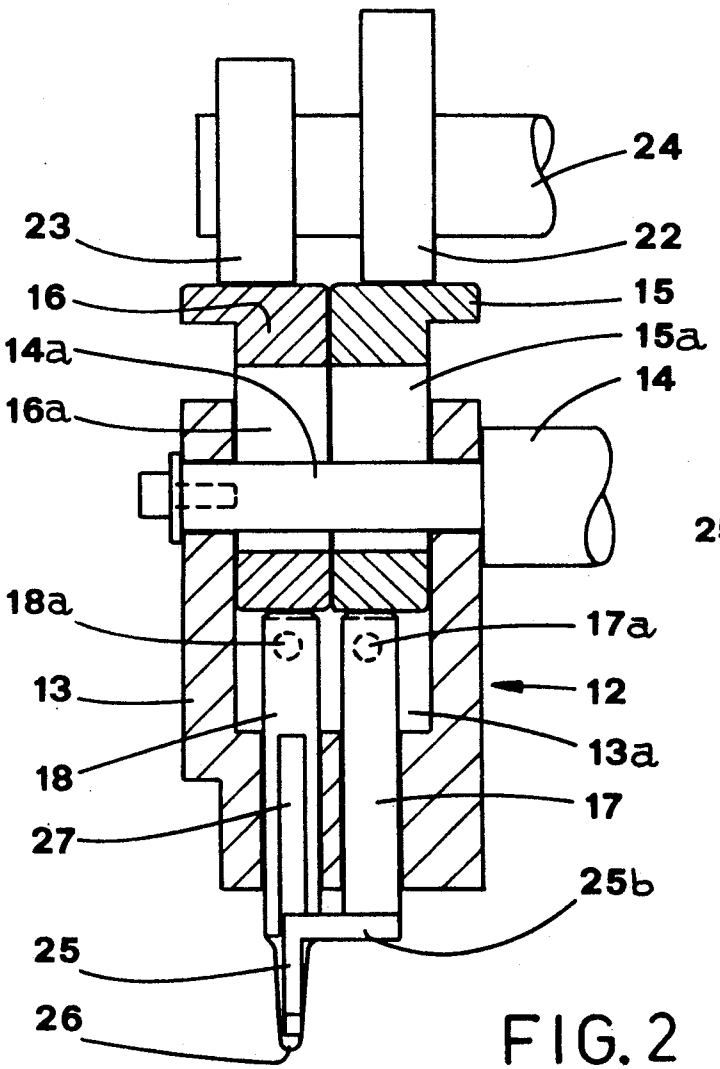
FIG. 2 is the sectional view II—II of FIG. 1.

The presser feet 25,26 operate side by side, and since the inner presser foot projects towards the stem 18, via a small arm 25b, the same stem 18 features a vertical groove 27 in its outer surface adapted to freely receive the outer vertical side 25c of the inner presser foot 25 (FIG. 2).

A pin 17a,18a is secured to each stem 17,18 and crosses a respective slot 30 made in the longitudinal wall of the case 13.

Springs 19 are hooked with an end to each pin while the remaining end is fixed to a bar 20 that is made integral with a protrusion 21a.

The protrusion 21a projects from a plate 21 that is secured to the wall of the case 13 from which the pins 17a,18a protrude (FIG. 1).

The action of the springs 19 is enough to keep the upper end of the respective stems 17,18 constantly in abutment on the respective overhanging slides 15,16.

Furthermore the springs keep the upper end of the slides abutting on respective cams 22,23 that are keyed on a third longitudinal shaft 24.

This shaft 24 is made to rotate, in a known manner, so as to complete a turn for each full oscillation of the needle 7 (to-and-fro strokes).

The shaft 24 is also made to move longitudinally and in synchrony with the axial motion of the shaft 14, according to a known way.

From what above, it follows that the presser feet 25,26 are moved vertically, in time relation with each other but in an independent way, between end positions, i.e. raised positions K1,H1 and lowered positions K2,H2 respectively.

A description of the machine way of working will follow.

The leathers 4,5, as specified, are placed on the respective working surfaces P1,P2.

Particularly, the stitching of the upper edges 4a,5a of these leathers is accomplished with these edges properly folded as shown in the drawings.

Figure 3:
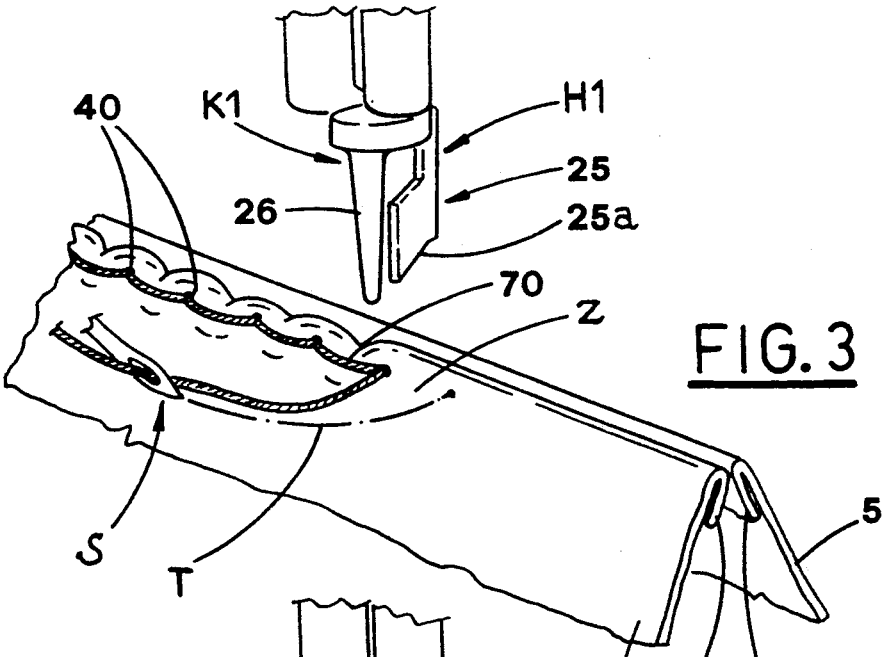

The FIG. 3 shows the position of the members of the machine being the subject of this invention, at the beginning of a single stitching cycle, that is with the needle 7 at the raised position S while both the presser feet 25,26 idle at the raised idle position H1,K1.

Reference numeral 40 indicates the stitches previously made while T indicates the path that the needle runs.

In time relation with the lowering of the needle, and before that this latter pierces the edges 4a,5a, the outer presser foot 26 is moved to the related operative lowered position K2, while the inner presser foot 25 remains at the position H1 (see FIG. 4); the lowering of the presser foot 26 is not hindered by the other presser foot due to the groove 27 made in the stem 18, thas is, the outer side 25c of the presser foot 25 freely runs in this groove.

In this way the thread portion 8a located between the lastly made stitch 40 and the hole 60 made by the needle 7 while piercing the edges 4a,5a, rests against the outer presser foot 26 and therefore it remains aside of the region Z of the leather 5 that is delimited by the last stitch 40, downstream of the needle, and by the hole 60, upstream of the stitch 40.

Before and during the edges piercing there are no vertical stresses on them, so that the mutual positioning of the same edges is not changed.

The needle 7, after having pierced the edges 4a,5a reaches its end lowered position A (see FIG. 4) in which it is located in the operative zone of the "crochet" 10; this latter, while oscillating, hooks the loop formed by the thread 8 carried by the needle 7.

When the operating members described above are at the position shown in FIG. 4, the leathers 4,5 are fed in synchrony, like shown, for example, in the already mentioned U.S. Pat. No. 4,848,252.

This advancement (in the direction N) is accomplished in synchrony with the longitudinal movement of the needle 7 and of the wrinkling device 12, in the same direction.

At the end of this movement, while the outer presser foot 26 is still resting at the operative position K2, the inner presser foot is lowered until it reaches its operative position H2 (see FIG. 5).

This fact causes the head 25a of the inner presser foot 25 to wrinkle the region Z; this operation is not hindered by the portion 8a of the thread 8, because it is still kept aside by the outer presser foot 26, while the vertical downward stress provoked by the inner presser foot 25 and acting on the edge 4a, do not lead to any movement for the edges 5a,4a in the region of the hole 60, because of the fixing action of the needle 7.

The beginning of the needle raising causes a loop to be formed in the thread 8, this loop being hooked by the "crochet" as already mentioned.

While the needle is raising the thread 8 is kept under tension, and therefore also the portion 8a is under tension.

Figure 6:
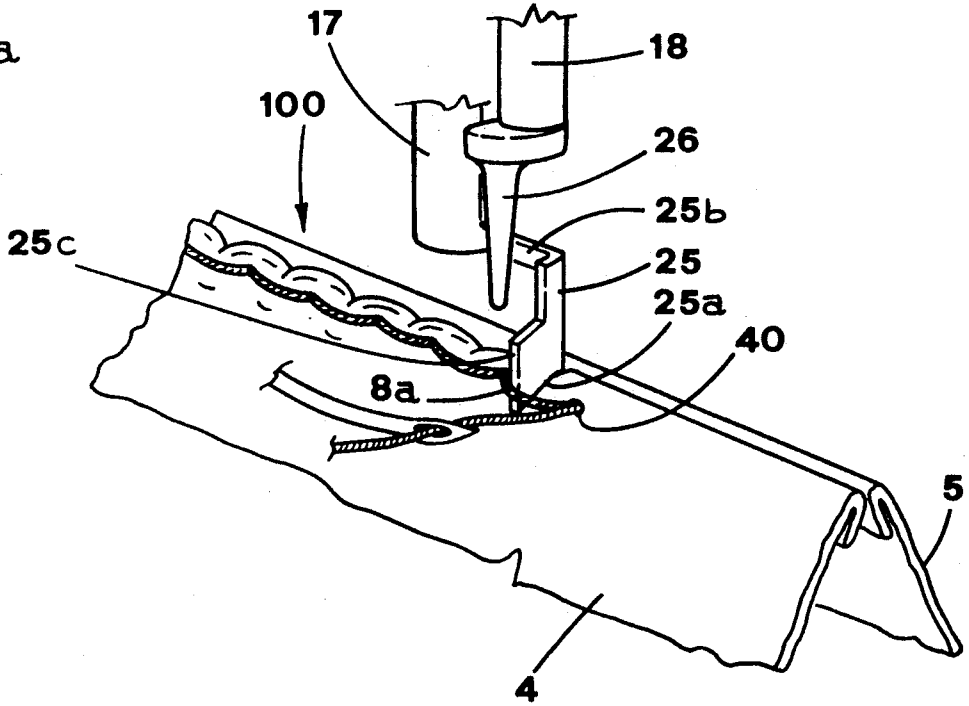
FIGS. 3,4,5 and 6 show schematic perspective views of subsequent phases of a stitching cycle.

At this moment, the outer presser foot 26 is raised, so that the portion 8a is released from it, and is temporarily held by the inner presser foot 25, this latter being still at the operative position H2 (FIG. 6).

Lastly, also the inner presser foot is raised so that the portion 8a is released from this latter.

The portion 8a is under tension and then it pushes on the outer surface of the region Z.

In this way the wrinkle 70 is kept due to the thread portion 8a that is strongly pressed on the region Z of the leather 4.

The stitch 40 is such that a possible decrease of the tension in the portion 8a is not possible.

Therefore the stitching 100 is obtained with an edge 4a provided with wrinkles 70 alternated with stitches 40.

At this moment the needle 7 and the wrinkling device 12 are made to move longitudinally in the direction opposite to the direction N, so that the operating conditions shown in FIG. 3 are restored.

The shape of the wrinkles made along the edge 4a depends on the profile of the lower head 25a of the inner presser foot 25.

What is claimed is:

1. In an automatic machine for sewing articles made of leather and comprising:

a longitudinal guide that forms two sloping flat surfaces converging at the top and forming first and second working surfaces respectively, with articles to be sewn arranged on top of said working surfaces;

a first shaft oriented longitudinally and rotatably supported over said guide, this first shaft being made to reciprocate axially and to move with to-and-fro movement in time relation with its reciprocating motion; an arm keyed onto said first shaft;

a needle extending in an arc and provided with a thread, this needle being tangentially secured to the free end of said arm and alternatively situated, as a result of the reciprocating motion of the first shaft, at a raised position, located aside of said first working surface, and at a lowered position in which the needle passes through a transverse hole made in said guide while piercing upper edges of said articles;

a rotary hook device located aside of said second working surface and adapted for cooperating with said needle to make stitches;

means moved longitudinally with a to-and-fro motion in time relation with with the oscillatory motion of said needle and designed to feed said articles in a preset direction and in synchrony with the motion of said shaft in the same direction, a wrinkling device moved longitudinally in synchrony with the axial translation of said first shaft;

an inner presser foot and an outer presser foot with respect to said underlying first working surface, these presser feet being connected with said wrinkling device and moved independently of each other between a raised idle position and a lowered operative position, said inner presser foot being adapted to make, when at its operative position, a wrinkle arranged along a region of said upper edge of said article situated on top of said first working surface, while said outer presser foot holds, when at the operative position, a thread portion that is external with respect to said wrinkle;

means connected to said wrinkling device for moving vertically said presser feet in time relation with the oscillatory motion of said needle, so that the raising of said outer presser foot, that occurs in time relation with the raising of said needle and before the raising of said inner presser foot, causes said thread portion to be released from said outer presser foot and to be subsequently temporarily held by said inner presser foot, from which it is lastly released so as to press the outer surface of the said region to fix said wrinkle.

2. The machine of claim 1, wherein said means for vertically moving said presser feet comprise:

a second longitudinal shaft that is moved axially in synchrony with the axial motion of said first shaft; a case born by said second longitudinal shaft;

two vertical stems slidably guided by said case and each at a lower end with one of the said presser feet;

a third longitudinal shaft that moves axially in synchrony with the axial motion of said first and second shafts;

two cams keyed onto said third longitudinal shaft, each one of the cams acting axially onto a related stem;

elastic means connected to said stems to contrast the action of said cams.

3. The machine of claim 1, wherein said wrinkling device includes a case having a seat open at the top and supported by a second longitudinal shaft that is moved axially in synchrony with the axial motion of said first shaft, while said means for vertically moving said presser feet include:

two vertical stems guided slidibly by the bottom of said case, a lower end of each of said stems being equipped with one of said presser feet;

a third longitudinal shaft moved longitudinally in synchrony with the axial motion of said first and second shafts;

two cams keyed onto said third shaft;

two slides inserted in the seat of said case and featuring vertical slots for freely engaging a portion of said second shaft that crosses said seat, each of said slides being arranged between an upper end of a related stem and one of said cams;

elastic means acting on said stems and contrasting the action of said cams on the related stem.

4. The machine of claim 1, wherein a lower head of said inner presser foot is shaped like a plate and extends vertically, said inner presser foot being connected to a related stem by a transverse little arm, while said stem connected to said outer presser foot has a vertical groove on an outer surface, adapted to receive freely the vertical outer side of said inner presser foot.

5. The machine of claim 2, wherein each stem has a related pin perpendicularly secured to it, said pin projecting out of said case while passing through a slot aligned with it and made in a wall of said case, with an end of said elastic means hooked to a free end of said pin while a remaining end of said elastic means is hooked to the case.

6. The machine of claim 1, wherein said outer presser foot is shaped like a truncated cone with a diameter enlarging from the bottom to the top.

7. The machine of claim 3, wherein each stem has a related pin perpendicularly secured to it, said pin projecting out of said case while passing through a slot aligned with it and made in a wall of said case, with an end of said elastic means hooked to a free end of said pin while a remaining end of said elastic means is hooked to the case.

* * * * *